US007398868B2

(12) United States Patent
Morszeck

(10) Patent No.: US 7,398,868 B2
(45) Date of Patent: Jul. 15, 2008

(54) SUITCASE COMPRISING MOUNTED POCKETS

(75) Inventor: Dieter Morszeck, Cologne (DE)

(73) Assignee: RIMOWA GmbH, Cologne (DE)

( * ) Notice: Subject to any disclaimer, the term of this patent is extended or adjusted under 35 U.S.C. 154(b) by 13 days.

(21) Appl. No.: 10/557,136

(22) PCT Filed: Aug. 21, 2003

(86) PCT No.: PCT/EP03/09270

§ 371 (c)(1),
(2), (4) Date: Nov. 17, 2005

(87) PCT Pub. No.: WO2004/103114

PCT Pub. Date: Dec. 2, 2004

(65) Prior Publication Data

US 2006/0243550 A1 Nov. 2, 2006

(30) Foreign Application Priority Data

May 23, 2003 (DE) ..... 203 08 245 U

(51) Int. Cl.
*A45C 13/00* (2006.01)

(52) U.S. Cl. ..... 190/110

(58) Field of Classification Search ..... 190/109–111
See application file for complete search history.

(56) References Cited

U.S. PATENT DOCUMENTS

| | | | | |
|---|---|---|---|---|
| 3,410,376 | A * | 11/1968 | Benzel | 190/110 |
| 3,606,372 | A * | 9/1971 | Browning | 280/47.17 |
| 3,799,568 | A * | 3/1974 | Hager | 280/37 |
| 4,122,925 | A | 10/1978 | Schultheiss | |
| 4,504,000 | A | 3/1985 | Doyel | |
| 4,693,345 | A * | 9/1987 | Mittelmann | 190/108 |
| 5,111,919 | A * | 5/1992 | Hamatani et al. | 190/109 |
| 5,116,289 | A * | 5/1992 | Pond et al. | 190/18 A |
| 5,310,031 | A * | 5/1994 | Plath | 190/18 A |
| 6,367,603 | B1 * | 4/2002 | Tiramani et al. | 190/100 |

* cited by examiner

*Primary Examiner*—Tri M Mai
(74) *Attorney, Agent, or Firm*—Diller, Ramik & Wight

(57) ABSTRACT

Disclosed is a suitcase (1) comprising two metal or plastic shells (3, 5) that are hingedly connected to each other and can be locked on frame elements (9) by means of a locking device (7), said frame elements (9) being located on edges of the suitcase shells. At least one main area (11) of the suitcase shells (3, 5) is provided with an embedded cavity (13) inside which at least one pocket (15) is fixed via a base plate (17).

12 Claims, 2 Drawing Sheets

SUITCASE COMPRISING MOUNTED POCKETS

BACKGROUND OF THE INVENTION

The invention refers to a suitcase as defined in the preamble of claim 1.

Such shell suitcases, whose case shells are preferably made of plastic material or metal and which are hinged together at one edge of the case shells, are known.

Frame elements are provided at the edges of the case shells, which have a closing means for closing the suitcase. Further, suitcases with two case shells are known that have a zipper as the closing means. The zipper may additionally be provided with a lock.

Further, suitcases are known that are made of textile material. They may be provided with additional, easily accessible side pockets on their outside.

SUMMARY OF THE INVENTION

It is an object of the invention to provide a suitcase of the type mentioned above which is made of strong shells and additionally has pockets attached on the sides.

The object is achieved according to the invention by providing at least one major surface of the case shells with a countersunk trough-shaped recess in which at least one pocket is fastened over a base plate. The trough-shaped recess may be formed, for example, by deep drawing during the manufacture of the case shell. The invention advantageously allows to provide a strong shell suitcase having easily accessible pockets on the outside.

Thus, it is possible to store e.g. travel documents or other travel implements in an easily accessible manner without having to open the complete suitcase.

Preferably, it is provided that the at least one pocket has a major surface facing the case shell fastened on the outside of the base plate via a base layer. The base layer folds around the edges of the base plate such that the edges of the base layer are invisible after the base plate is set into the recessed case shell. Thus, it is possible to fasten the pockets to the suitcase in a strong manner and to still give the suitcase an optically appealing exterior. The base layer may be of the same material as the at least one pocket and/or may be part of the pocket.

In an alternative embodiment, the base plate may also be part of the pocket.

Preferably, the pocket is made of a textile material or flexible plastics. Thus, the unfilled pocket is easy to compress and does not require too much space.

At least two rollers are affixed to the major standing surface of the suitcase.

Preferably, the suitcase is designed as a trolley.

The base plate may be glued in the recess or sewn with the case shell in the recess, preferably together with the base layer and/or the pocket. This ensures a strong fastening of the pocket to the case shells, which moreover means little production effort.

The case shells may be made of aluminum, an aluminum alloy or polycarbonate.

The frame elements of the suitcase may be made of plastics material or metal and may be designed as a rand ribbon sewn to the edge of the case shells together with a zipper as a closing means.

Preferably, the at least one pocket has at least one pocket opening adapted to be closed with at least one closing means, preferably a zipper.

Hereunder, embodiments of the invention will be detailed with reference to the drawings.

DESCRIPTION OF THE PREFERRED EMBODIMENTS

Figure 1:
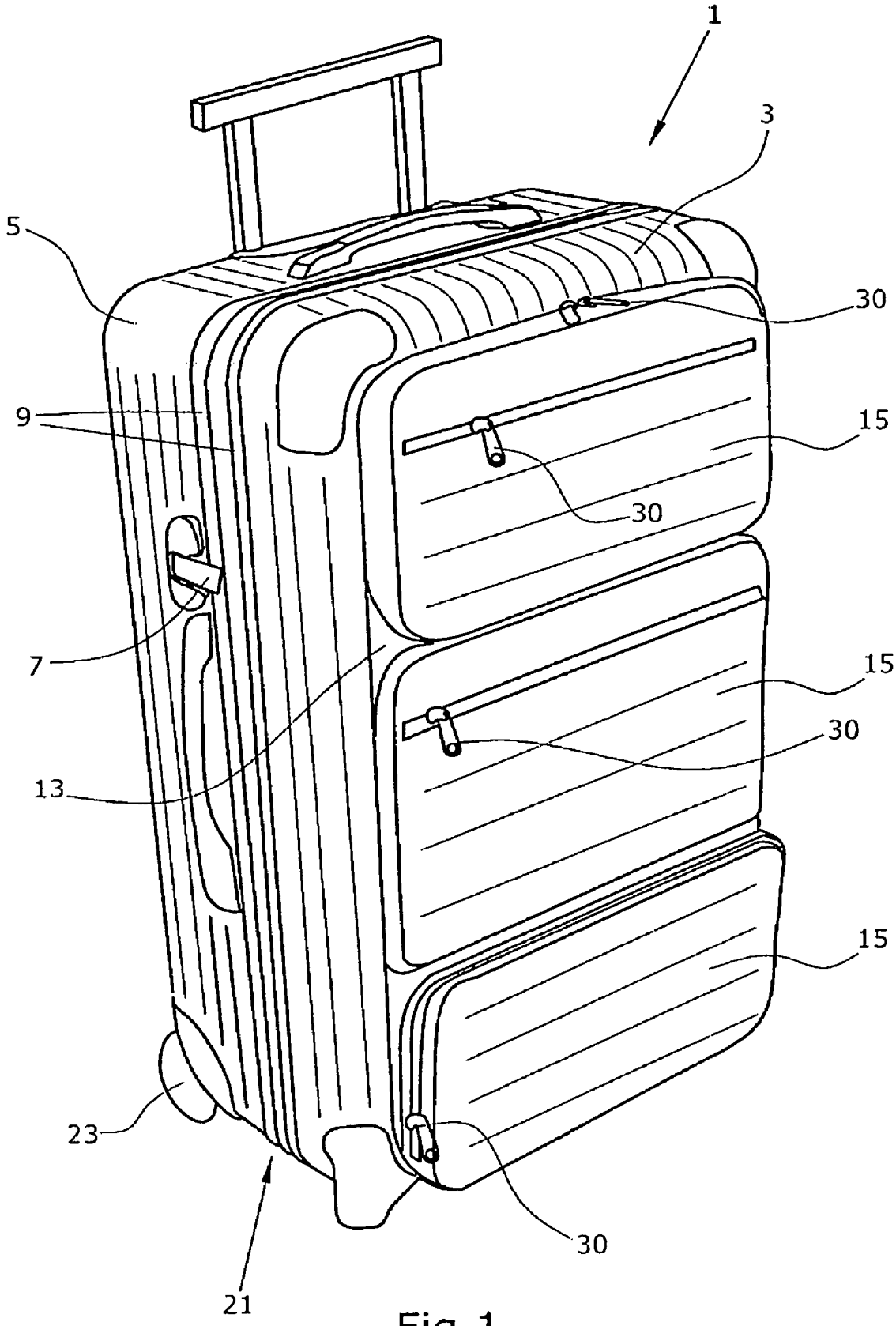
FIG. 1 is a perspective view of the suitcase according to the invention.

FIG. 1 illustrates a suitcase 1 with two case shells 3, 5 hinged together at the bottom of the suitcase 1 so as to be able to open the shell case 3 illustrated as the front one in FIG. 1. The edge of the case shells 3, 5 is provided with a closing means 7 in the form of a zipper which is sewn to the edges of the case shells 3, 5 together with a frame element 9 formed by rand ribbons.

The embodiment illustrates a suitcase 1 with shell parts 3, 5 of different sizes. The smaller case shell 3 has a countersunk recess 13 in its major surface, in which a base plate 17 is fastened. The outward directed face of the base plate 17 is covered by a base layer 19. The base layer 19 is folded around the edges of the base plate 17. In this embodiment, three pockets 15 are fastened on the base layer.

In an alternative embodiment not illustrated, the base layer 19 may be part of the pocket. It is also possible that the base plate 17 is a part of the pocket 15.

At two neighboring corners of the major standing surface 21 of the suitcase 1, rollers 23 are provided such that the suitcase is adapted to trail behind a user pulling it. The embodiment illustrated illustrates the suitcase 1 designed as a trolley so that it stands upright on the major standing surface 21. It is self-understood that the suitcase may also be of another design.

In the embodiment illustrated, the three pockets 15 each have at least one pocket opening that, when the suitcase 1 stands on the major standing surface 21, are located in the respective upper portions of the pockets 15. The openings can each be closed with a zipper 30.

FIG. 1 illustrates a suitcase wherein the case shells 3, 5 have a groove structure perpendicular to the major standing surface 21, whereas the pockets 15 have a groove structure horizontal to the major standing surface 21. It is understood that the suitcase 1 may also have another groove structure or none at all.

Figure 2:
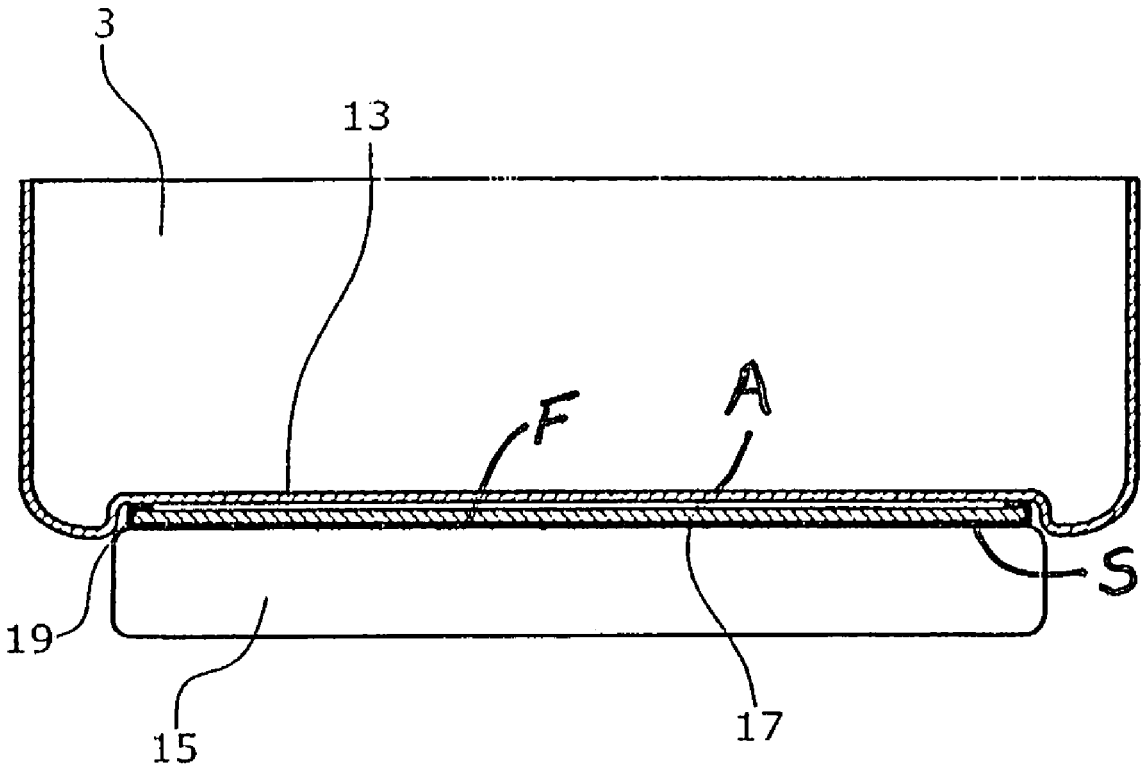
FIG. 2 is a section through the case shell with an attached pocket.

FIG. 2 is a cross section of the case shell 3 together with one of the pockets 15. The pocket 15 is sewn by conventional stitching S, for example, onto the base layer 19. The base layer 19 is conventionally fastened F to the base plate 17 and folded around the edges of the base plate 17. Together with the base layer 19, the base plate 17 is glued by conventional adhesive A, for example, into the recess 13 of the case shell 3. It is understood that the base plate 17 may also be riveted, sewn or otherwise fixed to the case shell 3.

What is claimed is:

1. A suitcase comprising two case shells (3, 5), at least one (3) of said two case shells (3, 5) having a major surface (11), an outwardly opening countersunk recess (13) formed in said major surface, at least one pocket (15) at least partially housed within said countersunk recess (13), a base (17) externally of said pocket (15) for effecting the fastening of said pocket (15) within said countersunk recess (13), said base (17) having a peripheral edge, a base layer (19) located between said pocket (15) and said base (17), said base layer (19) having a peripheral edge folded about said base peripheral edge, said pocket (15) having an innermost surface area substantially coextensive with and overlying said base layer (19), and said pocket (15) being secured in said at least partially housed relationship relative to said countersunk recess (13) by (i) means (F) for securing said base layer (19) to said base (17) and (ii) means (A) for securing said base (17) to said countersunk recess (13).

2. The suitcase as defined in claim 1 including further means (S) for sewing said base layer (19) to said pocket (15).

3. The suitcase as defined in claim 1 wherein at least one pocket (15) and said base layer (19) are made of substantially the same material.

4. The suitcase as defined in claim 1 wherein said base layer (19) at least in part defines said pocket (15).

5. The suitcase as defined in claim 1 wherein the base plate (17) is part of the pocket (15).

6. The suitcase as defined in claim 1 wherein the pocket 15 is made of at least one of textile material and flexible plastic material.

7. The suitcase as defined in claim 1 including means (23) for effecting rolling transport of said suitcase.

8. The suitcase as defined in claim 2 wherein at least one pocket (15) and said base layer (19) are made of substantially the same material.

9. The suitcase as defined in claim 2 wherein said base layer (19) at least in part defines said pocket (15).

10. The suitcase as defined in claim 2 wherein the base plate (17) is part of the pocket (15).

11. The suitcase as defined in claim 2 wherein the pocket 15 is made of at least one of textile material and flexible plastic material.

12. The suitcase as defined in claim 2 including means (23) for effecting rolling transport of said suitcase.

* * * * *